US006039210A

United States Patent [19]

Flowers

[11] Patent Number: 6,039,210

[45] Date of Patent: Mar. 21, 2000

[54] CONTAINER SYSTEM AND METHOD OF USE

[75] Inventor: Brian Lee Flowers, Los Angeles, Calif.

[73] Assignee: Gallopac Industries Inc., Los Angeles, Calif.

[21] Appl. No.: 09/055,533

[22] Filed: Apr. 6, 1998

[51] Int. Cl.[7] ..... G01F 11/00

[52] U.S. Cl. ..... 222/1; 222/105; 222/325; 222/481.5; 222/526; 222/539

[58] Field of Search ..... 222/1, 92, 105, 222/325, 481.5, 526, 538, 539

[56] References Cited

U.S. PATENT DOCUMENTS

| | | | |
|---|---|---|---|
| 3,958,729 | 5/1976 | Martin | 222/539 |
| 4,196,817 | 4/1980 | Moser | 222/105 |
| 4,601,410 | 7/1986 | Bond | 222/105 |
| 5,284,481 | 2/1994 | Soika et al. | 222/105 |

FOREIGN PATENT DOCUMENTS

| | | | |
|---|---|---|---|
| 87712 | 8/1957 | Denmark | 222/539 |

*Primary Examiner*—Joseph A. Kaufman

[57] ABSTRACT

A container system (20) includes a bladder (30), a pouring spout (34), and a holder (44). The pouring spout is removably connected to the bladder. The bladder is rolled around the pouring spout and inserted into the holder for convenient storage. To be used, the bladder is removed from the holder, unrolled, and filled with a liquid.

3 Claims, 3 Drawing Sheets

CONTAINER SYSTEM AND METHOD OF USE

TECHNICAL FIELD

The present invention relates generally to the field of containers, and more particularly to a gasoline container system which includes a bladder, a removable pouring spout, and a holder. When the bladder is empty it is rolled around the pouring spout and inserted into the holder for convenient storage.

BACKGROUND ART

Gasoline containers of innumerable types are well known in the art. These devices typically include a hollow body and some type of pouring spout or nozzle. For example, U.S. Pat. No. 4,834,270 shows a container for gasoline or other liquids which includes a hollow body having an outwardly directed pouring spout. A main valve closes the outer end of the spout. The main valve is in the form of a conical plug having a smooth surface, whereby liquid is poured from the spout in a laminar, hollow cylindrical flow pattern thereby avoiding splashing. U.S. Pat. No. 5,226,574 illustrates an inexpensive portable dispensing container for liquid fuel. The container is molded of plastic and has a top fill opening and a top, diagonally molded into the container itself. The spout is slightly flexible. During use the tip of the spout is placed in a position in which it extends upwardly into the entrance end of a downwardly extending inlet to an automobile gas tank. The container is then rotated to dispense the gasoline. U.S. Pat. No. 5,406,994 shows a portable gasoline container which includes a mechanism for enabling a user to readily determine when the tank is full and when fluid flow from the portable container into the tank has stopped. The mechanism includes a window in a wall of the container and a deflector connected to the pour spout which extends into the interior of the container for directing air bubbles entering the container through the pour spout toward the window. U.S. Pat. No. 5,564,608 discloses a transportable safety gasoline container suitable for use in the work place. The gasoline container has safety features that include an automatically venting pour spout, a protective skirt on top of the gasoline container to prevent damage to valves and fittings, and a pressure relief cap which satisfies the various regulations associated with using gasoline containers in the work place as well as for the transportation of such gasoline containers. U.S. Pat. No. 5,598,955 shows a gasoline dispensing container with a safety feature for safely dispensing or drawing in volatile fluids such as gasoline. The device includes a flexible siphon hose for filling other containers or drawing in fluid from other containers. The fluid flow is controlled by the pressure applied to a flexible surface of the container. In the normal storage position, the container cannot leak fluid out of the siphon.

DISCLOSURE OF INVENTION

The present invention is directed to a gasoline container system which includes a bladder, a removable pouring spout, and a holder. The bladder may be filled with gasoline and used as a transport vessel. When the bladder is empty, it is rolled or folded around the pouring spout and inserted into the holder for storage and protection. The bladder-pouring spout-holder package occupies a volume that is a fraction of the volume of the filled bladder. This allows the package to be conveniently stored in the trunk of an automobile for long periods of time without taking up a lot of space for use during the infrequent event when a motorist runs out of gasoline and needs a container to transport gasoline to the disabled vehicle.

While the present invention is primarily directed to gasoline containers, the principles of the invention apply equally to containers for other liquids. A possible marketing name for the present invention is "GALLOPAC".

In accordance with a preferred embodiment of the invention, the container system includes a bladder, a removable pouring spout, and a holder. The bladder is rolled or folded around the pouring spout and inserted into the holder. In a preferred embodiment the holder comprises a storage tube which has a removable cap.

In accordance with an important aspect of the invention, the removable pouring spout serves as a mandrel about which the bladder is rolled.

In accordance with an important feature of the invention, the pouring spout is positionable inside the bladder so that the bladder substantially surrounds the pouring spout, thereby facilitating the rolling operation.

In accordance with another aspect of the invention, the bladder has a flexible carrying handle.

Other features and advantages of the present invention will become apparent from the following detailed description, taken in conjunction with the accompanying drawings, which illustrate, by way of example, the principles of the invention.

BRIEF DESCRIPTION OF DRAWINGS

FIG. 6 is a perspective view of a container system in accordance with the present invention with the cap off; and, FIG. 7 is a perspective view of a container system with the cap on.

MODES FOR CARRYING OUT THE INVENTION

Figure 1:
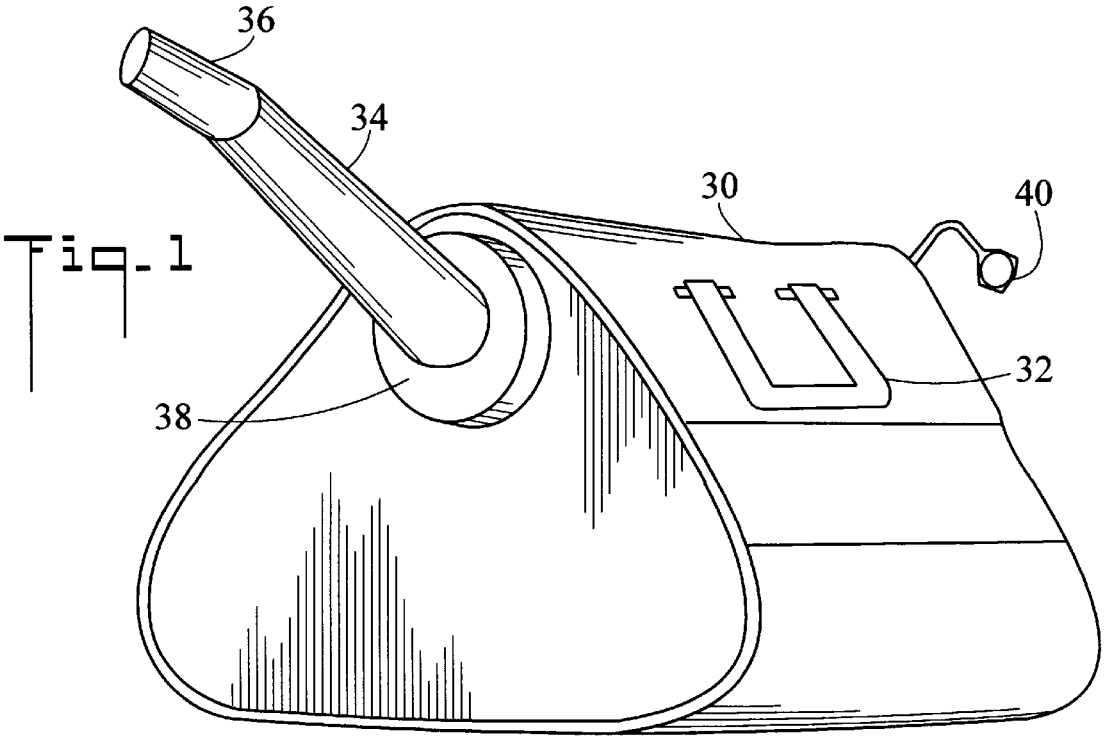
FIG. 1 is a perspective view of a filled bladder having a pouring spout in accordance with the present invention.
Figure 3:
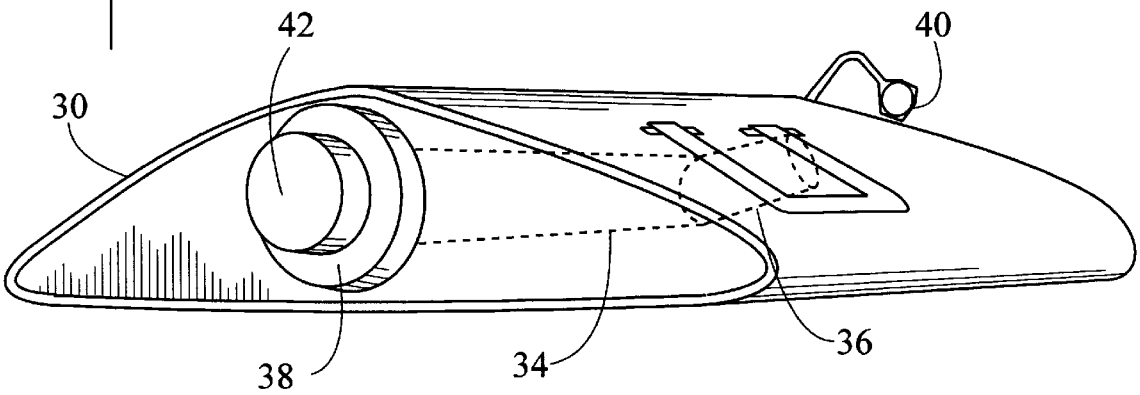
FIG. 3 is a perspective view of the bladder in an empty substantially flattened configuration with the pouring spout removed and positioned inside the bladder.

Referring initially to FIG. 1, there is illustrated a perspective view of a filled bladder ready to dispense gasoline, in accordance with the present invention, generally designated as 30. Bladder 30 is fabricated from rubber, plastic, or other flexible gasoline resistant material. The carrying handle 32 is raised for lifting the bladder and is preferably fabricated of flexible plastic in order to facilitate the rolling of the bladder as shown in FIG. 3. A pouring spout 34 having a tip 36 is removably connected to bladder 30 by a cap ring 38 screwed onto matching threads on the bladder. The spout is of ridged or semi-ridged plastic or metal construction. An air vent may be positioned on the rear of the bladder having a vent cap 40 which is removed in order to allow air to flow into the bladder as gasoline pours out the spout.

Figure 2:
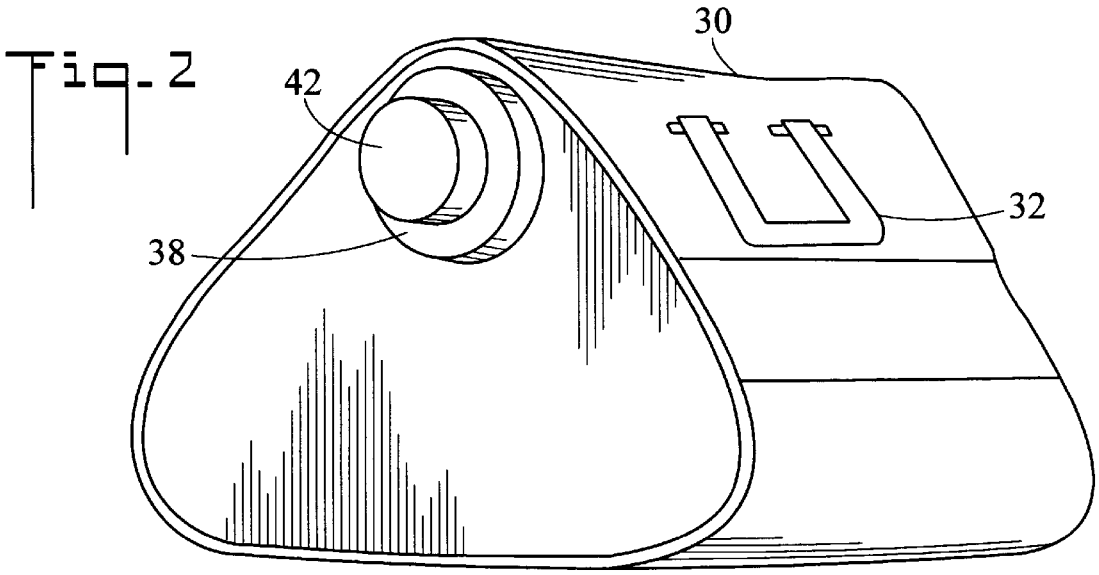
FIG. 2 is a perspective view of a filled bladder set up for storing gasoline.

FIG. 2 is a perspective view of a filled bladder 30 set up for storing gasoline. When the bladder is to be used for the storage of gasoline instead of dispensing gasoline as shown in FIG. 1, the cap ring 38 with the spout is unscrewed from the bladder, the spout is pushed out of the cap ring, an insert 42 is inserted into the resulting hole in the cap ring, and the spout is reversed and its base is placed inside the cap ring. The cap ring-insert-spout combination is then returned to the bladder with the spout inserted inside the bladder for convenient storage and the cap ring with insert is screwed onto the bladder to contain the gasoline inside as shown in FIG. 2.

FIG. 3 is a perspective view of bladder 30 in an empty substantially flattened configuration. Pouring spout 34, shown in dotted outline, has been reversed in cap ring 38 with an insert 42 between the spout and cap ring. The tip 36 of the spout is then inserted inside the bladder so that the bladder substantially surrounds the spout.

Figure 4:
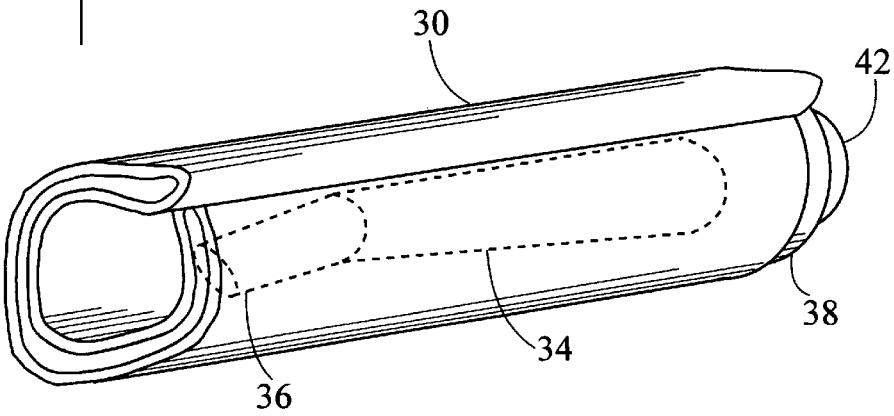
FIG. 4 is a perspective view of the rear end of the bladder rolled up around the pouring spout.

FIG. 4 is a rear end perspective view of bladder 30 rolled up or folded to substantially surround spout 34 which is shown in dotted outline. The spout serves as a mandrel about which the bladder is rolled or folded.

Figure 5:
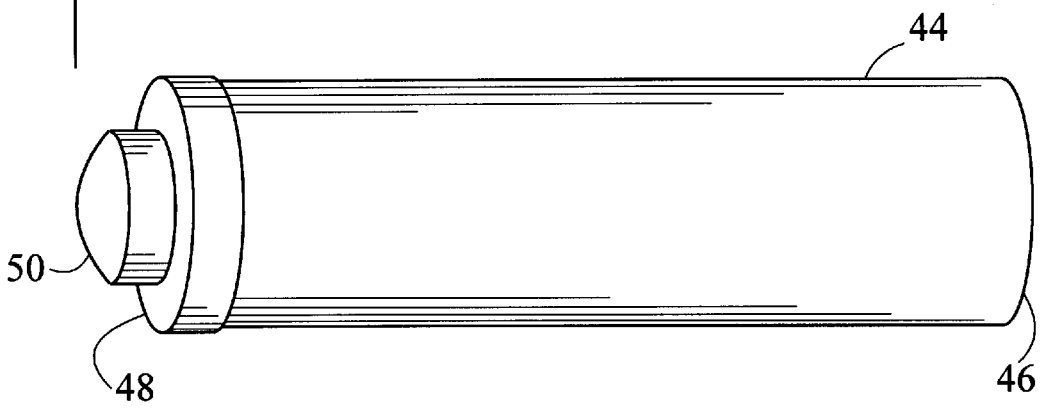
FIG. 5 is a perspective view of a holder having a removable cap.

FIG. 5 is a perspective view of a holder 44 having a first closed end 46, a second open end 48, and a removable cap 50 closing the second open end. In a preferred embodiment, holder 44 comprises a hollow cylindrical storage tube fabricated of paper or plastic. However, other shapes such as oval, rectangular, etc., could also be employed for the tube. Holder 44 could also be in the form of a bag which can be fabricated of any flexible material.

Figure 6:
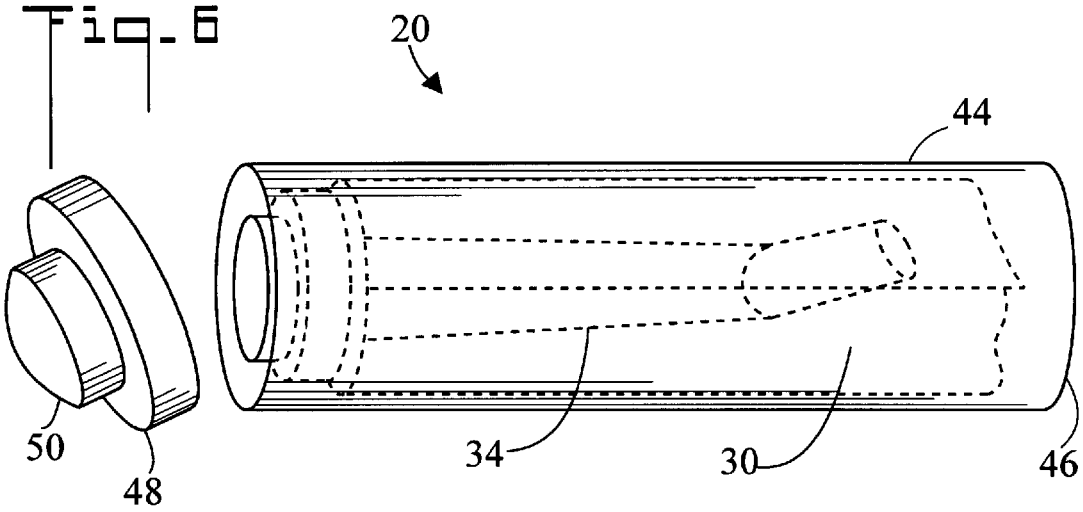

FIG. 6 is a perspective view of a container system in accordance with the present invention, generally designated 20, with the removable cap 50 off. For the purposes of facilitating the illustration, holder 44 is depicted as a clear plastic tube. Bladder 30 is rolled around pouring spout 34, shown in dotted outline, and is inserted into the holder. Together, holder 44 with bladder 30 rolled around pouring spout 34 installed inside comprises the container system 20 of the present invention.

Figure 7:
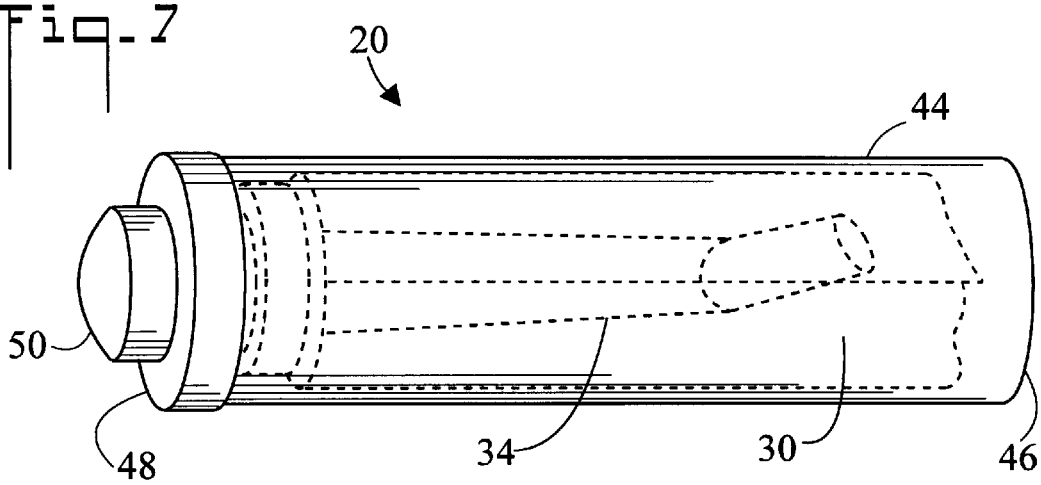

FIG. 7 is a perspective view of the container system 20 with the cap 50 on keeping the bladder 30 inside. Holder 44 serves to protect bladder 30 from punctures and other damage during storage of the container system 20 for long periods of time such as would occur in the trunk of a car.

Container system 20 is used in the follow manner. Removable cap 50 is removed from holder 44. Rolled bladder 30 is pulled out of the holder and is unrolled. Cap ring 38 is removed from the bladder with the spout 34. The bladder is filled with gasoline or other liquid. If the gasoline is to be stored in the bladder, the cap ring 38, insert 42, and spout 34 are returned to the bladder with the spout inside. The cap ring 38 is then screwed onto the bladder. If the gasoline is to be dispensed immediately from the bladder, the spout and insert are removed from the cap ring, the spout is reversed in the cap ring, and the cap ring with the spout is screwed onto the bladder creating the configuration shown in FIG. 1. The method for storing bladder 30 in holder 44 is essentially the reverse of the above.

The preferred embodiments of the invention described herein are exemplary and numerous modifications, dimensional variations, and rearrangements can be readily envisioned to achieve an equivalent result, all of which are intended to be embraced within the scope of the appended claims.

I claim:

1. A container system, comprising:

a bladder;

a pouring spout;

a holder;

said bladder rolled around said pouring spout and inserted into said holder; and, said bladder having a flexible carrying handle.

2. A method for providing a pouring container, comprising the steps of:

providing a bladder and a pouring spout, said bladder rolled around said pouring spout;

providing a holder, said rolled bladder disposed within said holder;

removing said rolled bladder from said holder;

unrolling said bladder;

filling said bladder with a liquid; and, connecting said pouring spout to said filled bladder so that said pouring spout outwardly projects from said bladder.

3. The method of claim 2, further including the steps of:

said holder comprising a storage tube;

said storage tube having a first closed end and a second open end;

providing a removable cap connected to said second end; and, removing said cap prior to said step of removing said rolled bladder from said holder.

* * * * *